US010857796B2

(12) United States Patent
Kakamu

(10) Patent No.: US 10,857,796 B2
(45) Date of Patent: Dec. 8, 2020

(54) LIQUID EJECTION HEAD AND LIQUID EJECTION DEVICE

(71) Applicant: BROTHER KOGYO KABUSHIKI KAISHA, Nagoya (JP)

(72) Inventor: Katsumi Kakamu, Kuwana (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/568,495

(22) Filed: Sep. 12, 2019

(65) Prior Publication Data

US 2020/0101732 A1 Apr. 2, 2020

(30) Foreign Application Priority Data

Sep. 28, 2018 (JP) ..... 2018-183365

(51) Int. Cl.
*B41J 2/14* (2006.01)

(52) U.S. Cl.
CPC ..... *B41J 2/1433* (2013.01); *B41J 2/14233* (2013.01)

(58) Field of Classification Search
CPC ..... B41J 2/01; B41J 2/14233; B41J 2/1433; B41J 2002/14241; B41J 2002/14419; B41J 2002/14459; B41J 2202/11; B41J 2202/12
See application file for complete search history.

(56) References Cited

U.S. PATENT DOCUMENTS

2006/0256159 A1* 11/2006 Owaki ..... B41J 2/14233 347/54
2012/0188298 A1 7/2012 Matsumoto et al.
2015/0273831 A1* 10/2015 Hirai ..... B41J 2/1607 347/71
2016/0288499 A1* 10/2016 Sugahara ..... B41J 2/18
2017/0182772 A1 6/2017 Gejima et al.

FOREIGN PATENT DOCUMENTS

JP 2011-093131 A 5/2011
JP 2011-143331 A 7/2011
JP 2015-131475 A 7/2015
JP 2017-165051 A 9/2017
WO WO 2015/125865 A1 8/2015

* cited by examiner

*Primary Examiner* — Anh T Vo
(74) *Attorney, Agent, or Firm* — Scully, Scott, Murphy & Presser, PC

(57) ABSTRACT

A liquid ejection head, including: first supply passages and first discharge passages extending in a first direction and arranged in a second direction intersecting the first direction; and a second supply passage extending in the second direction and communicating with the first supply passages to supply the liquid thereto and a second discharge passage extending in the second direction and communicating with the first discharge passages to discharge the liquid therefrom, wherein (A) a cross-sectional area of the second supply passage on a plane orthogonal to the second direction at a first portion thereof differs from that at a second portion thereof spaced apart from the first portion in the second direction and/or (B) a cross-sectional area of the second discharge passage on the plane at a first portion thereof differs from that at a second portion thereof spaced apart from the first portion in the second direction.

18 Claims, 10 Drawing Sheets

LIQUID EJECTION HEAD AND LIQUID EJECTION DEVICE

CROSS REFERENCE TO RELATED APPLICATION

The present application claims priority from Japanese Patent Application No. 2018-183365, which was filed on Sep. 28, 2018, the disclosure of which is herein incorporated by reference in its entirety.

BACKGROUND

Technical Field

The following disclosure relates to a liquid ejection head configured to eject a liquid from nozzles and a liquid ejection device including the liquid ejection head.

Description of Related Art

A liquid ejection device configured to eject a liquid from nozzles is known. The known liquid ejection device includes a plurality of individual passages each of which includes an ejection hole, a pressurizing chamber, etc., and which are arranged in a D1 direction. The known liquid ejection device further includes a plurality of first supply passages each of which extends in the D1 direction and which are arranged in a D2 direction that intersects the D1 direction. A part of the individual passages are connected to a corresponding one of the first supply passages. End portions of the respective first supply passages that are located on one end side in the D1 direction are connected to each other by a second supply passage that extends in the D2 direction. Ink is supplied to the second supply passage through an opening formed at its end located on one end side in the D2 direction. The known liquid ejection device further includes a plurality of first discharge passages each of which extends in the D1 direction and which are arranged in the D2 direction. A part of the individual passages are connected to a corresponding one of the first discharge passages. End portions of the respective first discharge passages that are located on the other end side in the D1 direction are connected to each other by a second discharge passage that extends in the D2 direction. Ink in the second discharge passage is collected through an opening forming at its end located on the other end side in the D2 direction.

SUMMARY

In the liquid ejection device constructed as described above, the ink is supplied from the second supply passage to the first supply passages. However, the ink is supplied to the second supply passage through the opening formed at its one end located on the one end side in the D2 direction. In this arrangement, the ink is less prone to flow from the second supply passage into the first supply passages with an increase in a distance by which each first supply passage is distant from the opening toward the other end side in the D2 direction. Further, the ink is less prone to flow into the second discharge passage from the first discharge passages with an increase in the distance by which each first discharge passage is distant from the opening toward the other end side in the D2 direction.

Accordingly, one aspect of the present disclosure is directed to a liquid ejection head configured such that a liquid is supplied from one second supply passage to a plurality of first supply passages and the liquid is discharged from a plurality of first discharge passages to one second discharge passage, the liquid ejection head enabling the liquid to flow uniformly in the first supply passages and the first discharge passages. Another aspect of the present disclosure is directed to a liquid ejection device including the liquid ejection head.

In one aspect of the present disclosure, a liquid ejection head includes: a plurality of individual passages respectively including nozzles; a plurality of first supply passages each extending in a first direction so as to be connected to a part of the individual passages, the first supply passages being arranged in a second direction that intersects the first direction, a liquid being supplied to the part of the individual passages through a corresponding one of the first supply passages; a plurality of first discharge passages each extending in the first direction so as to be connected to a part of the individual passages, the first discharge passages being arranged in the second direction, the liquid being discharged from the part of the individual passages through a corresponding one of the first discharge passages; a second supply passage extending in the second direction and overlapping the first supply passages in a third direction that intersects a plane parallel to both the first direction and the second direction, the second supply passage communicating with the first supply passages to supply the liquid to the first supply passages, a second discharge passage extending in the second direction and overlapping the first discharge passages in the third direction, the second discharge passage communicating with the first discharge passages to discharge the liquid from the first discharge passages; wherein, where an area of a cross section of the second supply passage on a plane orthogonal to the second direction is defined as a cross-sectional area of the second supply passage and two portions of the second supply passage spaced apart from each other in the second direction are respectively defined as a first portion and a second portion, (A) the cross-sectional area of the second supply passage at the first portion differs from the cross-sectional area of the second supply passage at the second portion, and/or (B) where an area of a cross section of the second discharge passage on a plane orthogonal to the second direction is defined as a cross-sectional area of the second discharge passage and two portions of the second discharge passage spaced apart from each other in the second direction are respectively defined as a first portion and a second portion, the cross-sectional area of the second discharge passage at the first portion differs from the cross-sectional area of the second discharge passage at the second portion.

BRIEF DESCRIPTION OF THE DRAWINGS

The objects, features, advantages, and technical and industrial significance of the present disclosure will be better understood by reading the following detailed description of an embodiment, when considered in connection with the accompanying drawings, in which.

DETAILED DESCRIPTION OF THE EMBODIMENT

There will be hereinafter explained one embodiment of the present disclosure.

Overall Structure of Printer

Figure 1:
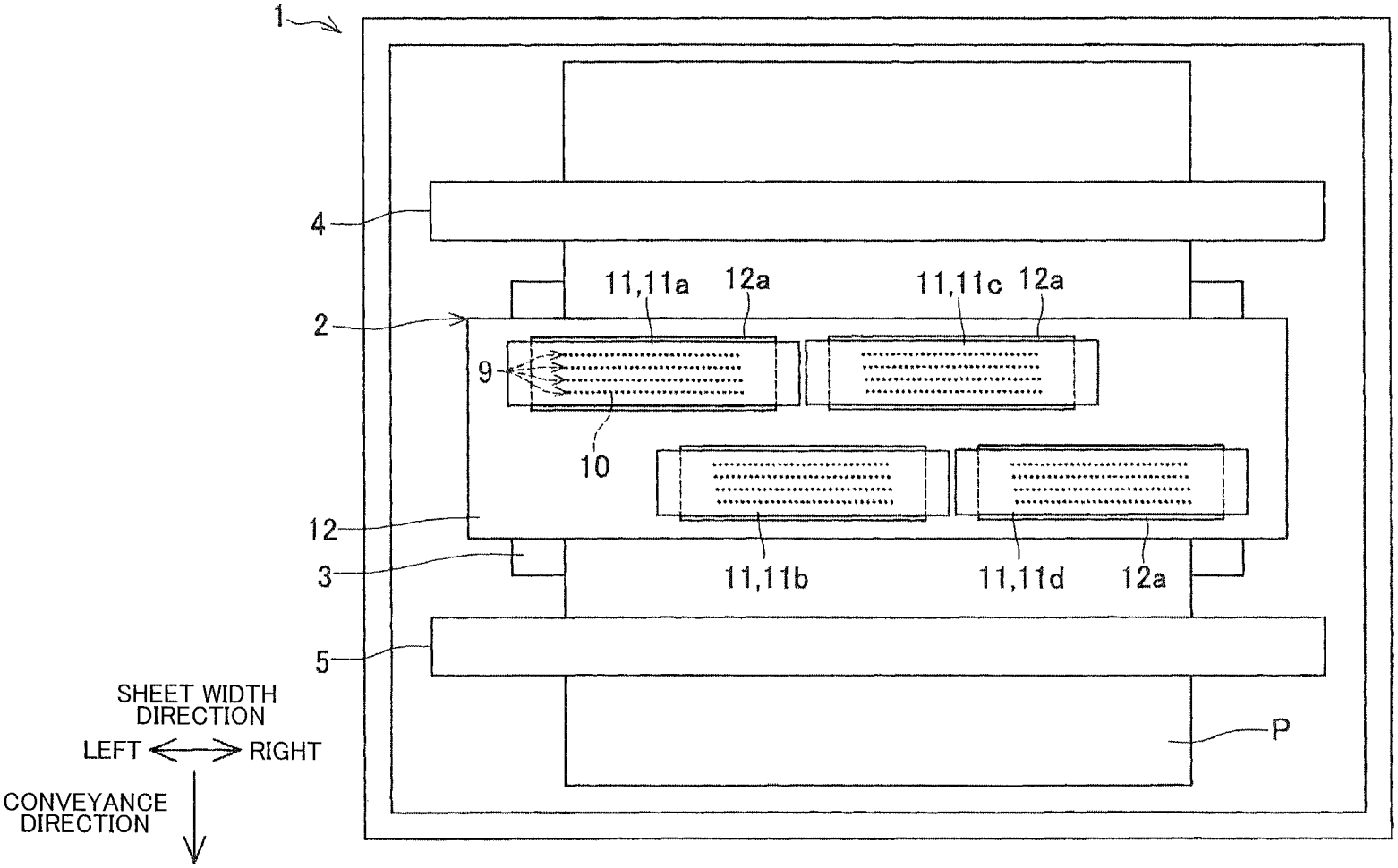
FIG. 1 is a schematic view of a printer according to one embodiment.

As shown in FIG. 1, a printer 1 according to the present embodiment (as one example of "liquid ejection device") includes an ink jet head 2, a platen 3, and conveyance rollers 4, 5.

Figure 2:
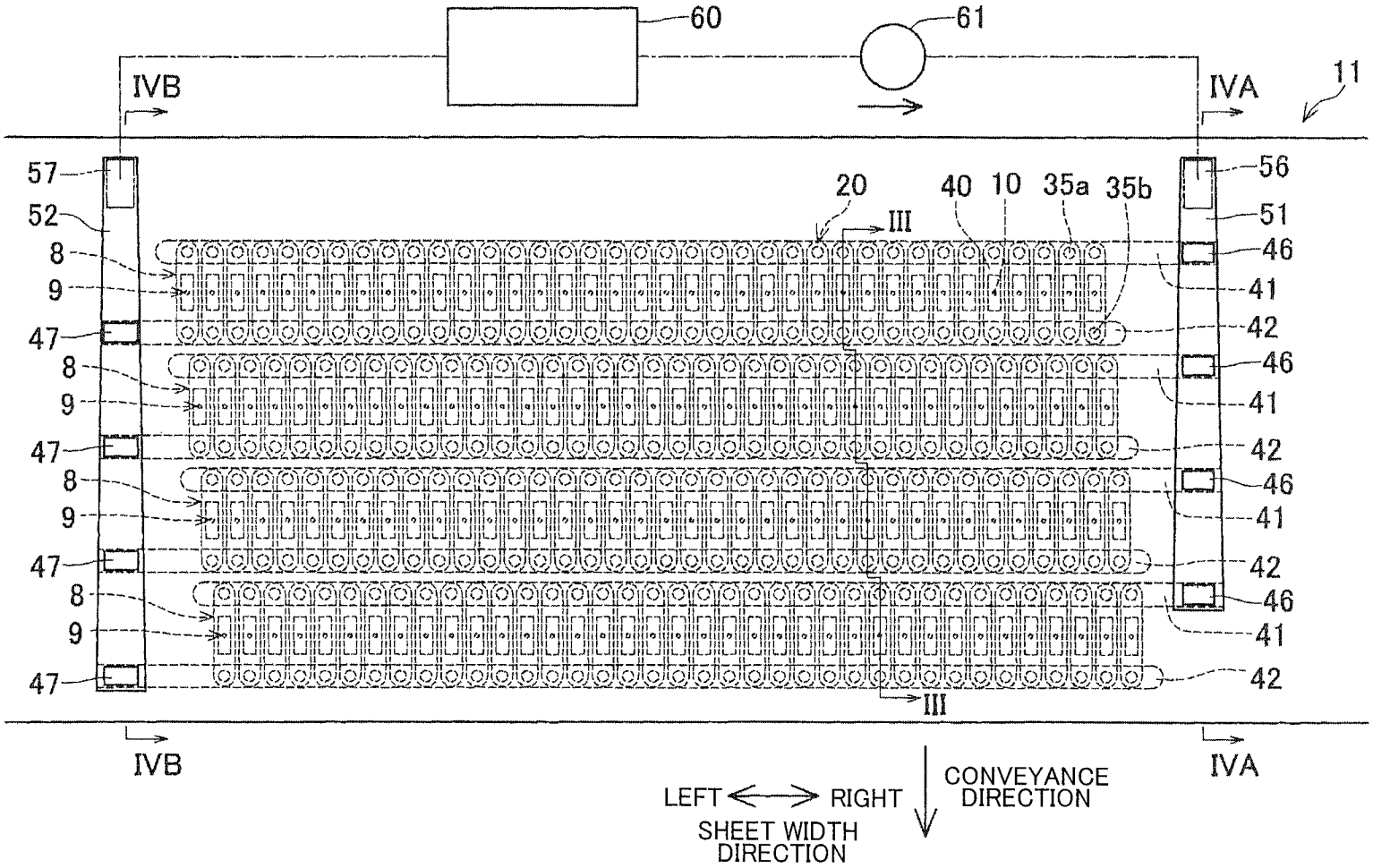
FIG. 2 is a plan view of a head unit.
Figure 3:
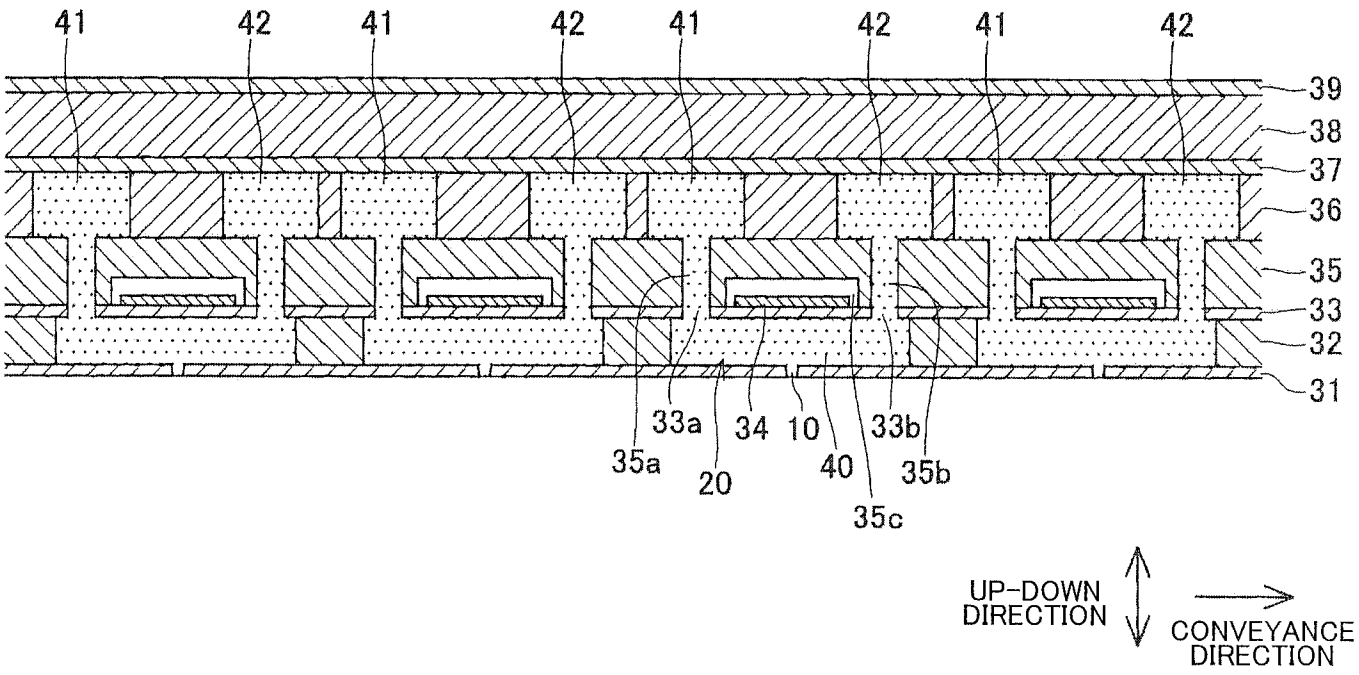
FIG. 3 is a cross-sectional view taken alone line in FIG. 2.
Figure 4A:
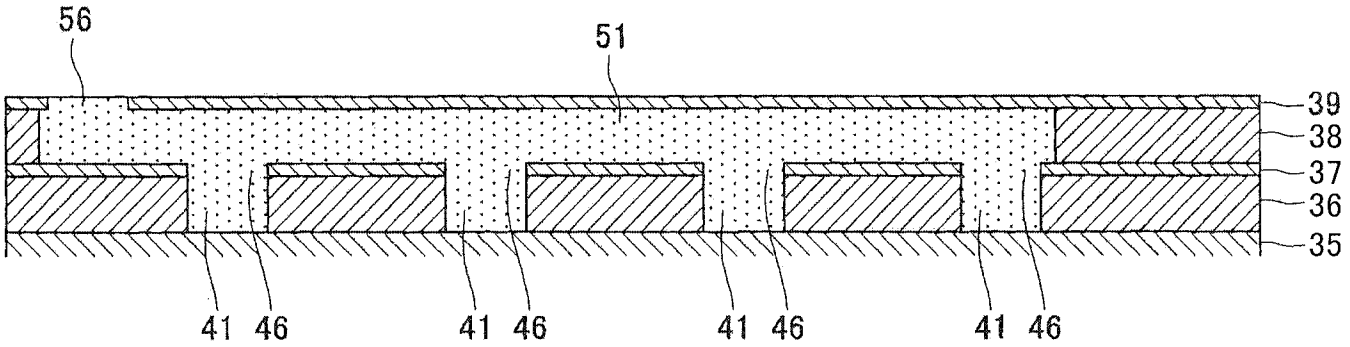
FIG. 4A is a cross-sectional view taken along line IVA-IVA in FIG. 2
Figure 4B:
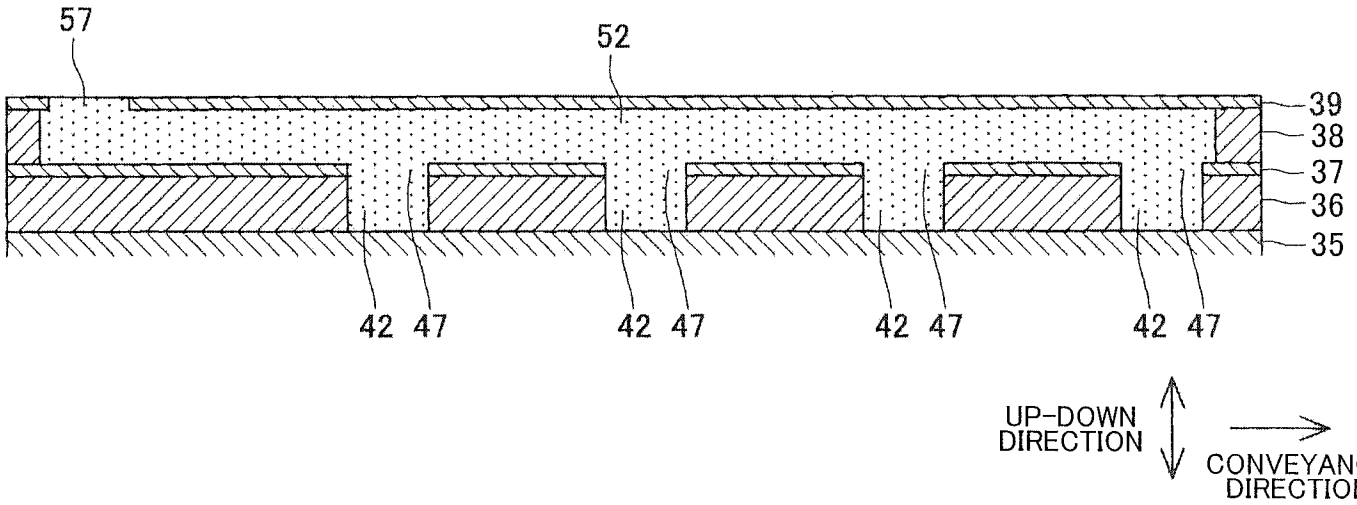
FIG. 4B is a cross-sectional view taken along line IVB-IVB in FIG. 2.

As shown in FIGS. 1 and 2, the ink-jet head 2 includes four head units 11 (11*a*-11*d*) and a holder 12. Each head unit 11 is one example of "liquid ejection head". Each head unit 11 ejects ink from a plurality of nozzles 10 formed in its lower surface. Specifically, the nozzles 10 are arranged in a sheet width direction (as one example of "first direction") so as to faun a nozzle row 9. Each head unit 11 includes four nozzle rows 9 arranged in a sheet conveyance direction (as one example of "second direction") orthogonal to the sheet width direction. Positions in the sheet width direction of the nozzles 10 in one of any two adjacent nozzle rows 9 are shifted with respect to those of the nozzles 10 in another one of the two adjacent nozzle rows 9 by a distance equal to a quarter of a nozzle pitch at which the nozzles 10 of each nozzle row 9 are arranged. It is noted that right and left sides are defined with respect to the sheet width direction as illustrated in FIG. 1. It is further noted that an upper side and a lower side in FIG. 1 are respectively defined as an upstream side and a downstream side in the sheet conveyance direction.

The head unit 11*a* and the head unit 11*c* are arranged in the sheet width direction, and the head unit 11*b* and the head unit 11*d* are arranged in the sheet width direction. The head units 11*b*, 11*d* are positioned downstream of the head units 11*a*, 11*c* in the sheet conveyance direction orthogonal to the sheet width direction. The head units 11*b*, 11*d* are shifted to the right in the sheet width direction with respect to the head units 11*a*, 11*c*. In the thus constructed ink-jet head 2, the nozzles 10 of the four head units 11 are arranged so as to extend over an entire dimension of a recording sheet P in the sheet width direction, namely, over an entire width of the recording sheet P. That is, the ink-jet head 2 is a line head. A detailed structure of the head units 11 will be later explained.

The holder 12 is a rectangular plate-like member whose longitudinal direction coincides with the sheet width direction. The four head units 11 are fixed to the holder 12. Four rectangular through-holes 12*a* are formed in the holder 12 so as to correspond to the four head units 11. The nozzles 10 of each head unit 11 are downwardly exposed (toward the recording sheet P) from a corresponding one of the through-holes 12*a*.

The platen 3 is disposed below the ink jet head 2 and opposed to the nozzles 10 of the four head units 11. The platen 3 is configured to support the recording sheet P from below. The conveyance roller 4 is disposed upstream of the ink-jet head 2 and the platen 3 in the sheet conveyance direction. The conveyance roller 5 is disposed downstream of the ink-jet head 2 and the platen 3 in the sheet conveyance direction. The conveyance rollers 4, 5 convey the recording sheet P in the sheet conveyance direction.

The printer 1 performs printing on the recording sheet P such that the ink is ejected from the nozzles 10 of the four head units 11 onto the recording sheet P being conveyed by the conveyance rollers 4, 5 in the sheet conveyance direction.

Head Unit

The head units 11 will be next explained. As shown in FIGS. 2, 3, 4A, and 4B, each head unit 11 includes a nozzle plate 31, a flow-passage member 32, a vibration film 33, a plurality of driving elements 34, a protection plate 35, and flow-passage plates 36-39.

The nozzle plate 31 is formed of a synthetic rein, for instance. The nozzles 10 of the four nozzle rows 9 are formed in the nozzle plate 31.

The flow-passage member 32 is formed of silicon (Si) and is disposed on an upper surface of the nozzle plate 31. A plurality of pressure chambers 40 are formed in the flow-passage member 32 so as to correspond to the respective nozzles 10. Each pressure chamber 40 overlaps, at a central portion thereof in the sheet conveyance direction, the corresponding nozzle 10 in an up-down direction (as one example of "third direction"). According to this configuration, there are formed, in the flow-passage member 32, four pressure chamber rows 8 each of which is constituted by the pressure chambers 40 arranged in the sheet width direction. The four pressure chamber rows 8 are arranged in the sheet conveyance direction.

The vibration film 33 is disposed on an upper end portion of the flow-passage member 32 so as to cover the pressure chambers 40. The vibration film 33 is formed of silicon dioxide ($SiO_2$) or silicon nitride (SiN). The vibration film 33 is formed by oxidization or nitriding of the upper end portion of the flow-passage member 32.

Inlet holes 33*a* are formed in the vibration film 33 such that each inlet hole 33*a* overlaps, in the up-down direction, an upstream end portion of the corresponding pressure chamber 40 in the sheet conveyance direction. Outlet holes 33*b* are formed in the vibration film 33 such that each outlet hole 33*b* overlaps, in the up-down direction, a downstream end portion of the corresponding pressure chamber 40 in the sheet conveyance direction.

The driving elements 34 are provided for the respective pressure chambers 40. Each driving element 34 is disposed at a portion of an upper surface of the vibration film 33, which portion overlaps the corresponding pressure chamber 40 in the up-down direction. Each driving element 34 is a piezoelectric element including a piezoelectric member, electrodes, etc., for instance. The driving elements 34 have a known structure, and a detailed explanation thereof is dispensed with.

The protection plate 35 is formed of silicon (Si) and disposed on an upper surface of the flow-passage member 32 on which the vibration film 33 and the driving elements 34 are provided. Supply orifices 35*a* are formed so as to extend through the protection plate 35 in the up-down direction at portions of the protection plate 35*a* that overlap the corresponding inlet holes 33*a* in the up-down direction. Discharge orifices 35*b* are formed so as to extend through the protection plate 35 in the up-down direction at portions of the protection plate 35 that overlap the corresponding outlet holes 33*b* in the up-down direction. In the present embodiment, one nozzle 10, one pressure chamber 40, one supply orifice 35*a*, and one discharge orifice 35*b* constitute one individual passage 20.

Recesses 35*c* are formed on the underside of the protection plate 35 at portions thereof that overlap the pressure chambers 40 of the pressure chamber rows 8 in the up-down direction. The driving elements 34 are disposed in the recesses 35*c* so as to correspond to the pressure chamber rows 8.

The flow-passage plate 36 is disposed on an upper surface of the protection plate 35. There are formed, in the flow-passage plate 36, four lower supply manifolds 41 (each as one example of "first supply passage") and four lower discharge manifolds 42 (each as one example of "first discharge passage").

The four lower supply manifolds 41 respectively correspond to the four pressure chamber rows 8 and are arranged in the sheet conveyance direction. Each lower supply manifold 41 extends in the sheet width direction throughout the pressure chambers 40 of a corresponding one of the four pressure chamber rows 8 and overlaps, in the up-down direction, the supply orifices 35*a* connected to the pressure chambers 40. Each lower supply manifold 41 extends to the right, in the sheet width direction, of a region in which the corresponding pressure chamber row 8 is disposed. Each lower supply manifold 41 has a substantially constant dimension (e.g., about 1.0 mm) in the sheet conveyance direction throughout the sheet width direction.

The four lower discharge manifolds 42 respectively correspond to the four pressure chamber rows 8 and are arranged in the sheet conveyance direction. Each lower discharge manifold 42 extends in the sheet width direction throughout the pressure chambers 40 of a corresponding one of the four pressure chamber rows 8 and overlaps, in the up-down direction, the discharge orifices 35*b* connected to the pressure chambers 40. Each lower discharge manifold 42 extends to the left, in the sheet width direction, of a region in which the corresponding pressure chamber row 8 is disposed. Each lower discharge manifold 42 has a substantially constant dimension (e.g., about 1.0 mm) in the sheet conveyance direction throughout the sheet width direction.

The flow-passage plate 37 is disposed on an upper surface of the flow-passage plate 36. There are Ruined, in the flow-passage plate 37, four supply connection openings 46 and four discharge connection openings 47.

The four supply connection openings 46 respectively correspond to the four lower supply manifolds 41. Each supply connection opening 46 overlaps, in the up-down direction, a right end portion of the corresponding lower supply manifold 41 in the sheet width direction. The four supply connection openings 46 are shaped like rectangles having mutually the same dimension in the sheet width direction and mutually the same dimension in the sheet conveyance direction, so that the four supply connection openings 46 have mutually the same cross-sectional area on a plane orthogonal to the up-down direction.

The four discharge connection openings 47 respectively correspond to the four lower discharge manifolds 42. Each discharge connection opening 47 overlaps, in the up-down direction, a left end portion of the corresponding lower discharge manifold 42 in the sheet width direction. The four discharge connection openings 47 are shaped like rectangles having mutually the same dimension in the sheet width direction and mutually the same dimension in the sheet conveyance direction, so that the four discharge connection openings 47 have mutually the same cross-sectional area on the plane orthogonal to the up-down direction.

The flow-passage plate 38 is disposed on an upper surface of the flow-passage plate 37. There are formed, in the flow-passage plate 38, an upper supply manifold 51 (as one example of "second supply passage") and an upper discharge manifold 52 (as one example of "second discharge passage").

The upper supply manifold 51 extends in the sheet conveyance direction so as to be across the four lower supply manifolds 41. The upper supply manifold 51 overlaps, in the up-down direction, the four supply connection openings 46 and the right end portions of the respective four lower supply manifolds 41 in the sheet width direction. The upper supply manifold 51 has a dimension in the sheet width direction that gradually increases toward the downstream side in the sheet conveyance direction, namely, a dimension in the sheet width direction that gradually increases with an increase in a distance from a supply opening 56 (which will be explained) in the sheet conveyance direction.

The upper discharge manifold 52 extends in the sheet conveyance direction so as to be across the four lower discharge manifolds 42. The upper discharge manifold 52 overlaps, in the up-down direction, the four discharge connection openings 47 and the left end portions of the respective four lower discharge manifolds 42 in the sheet width direction. The upper discharge manifold 52 has a dimension in the sheet width direction that gradually increases toward the downstream side in the sheet conveyance direction, namely, a dimension in the sheet width direction that gradually increases with an increase in the distance away from the supply opening 56 in the sheet conveyance direction.

The flow-passage plate 39 is disposed on an upper surface of the flow-passage plate 38. There are formed, in the flow-passage plate 39, the supply opening 56 and a discharge opening 57. The supply opening 56 overlaps, in the up-down direction, an upstream end of the upper supply manifold 51 in the sheet conveyance direction. The discharge opening 57 overlaps, in the up-down direction, an upstream end of the upper discharge manifold 52 in the sheet conveyance direction.

The supply opening 56 and the discharge opening 57 are connected to an ink tank 60 via respective flow passages not shown. A pump 61 is provided in the flow passage between the supply opening 56 and the ink tank 60. The pump 61 delivers the ink in a direction from the ink tank 60 toward the supply opening 56. That is, the pump 61 delivers the ink toward the upper supply manifold 51.

When the ink is delivered by the pump 61, the ink in the ink tank 60 flows into the head unit 11 through the supply opening 56. In the head unit 11, the ink flows through the upper supply manifold 51, the supply connection openings 46, and the lower supply manifolds 41, so as to flow into the individual passages 20 via the corresponding supply orifices 35*a*. Further, the ink in the individual passages 20 flows out of the corresponding discharge orifices 35*b* into the lower discharge manifolds 42, so as to return to the ink tank 60 via the lower discharge manifolds 42, the discharge connection openings 47, the upper discharge manifold 52, and the discharge opening 57. In this way, the ink is circulated between the ink tank 60 and the head unit 11.

Here, a case is considered in which the upper supply manifold 51 has a cross-sectional area on a plane orthogonal to the sheet conveyance direction that is substantially constant throughout the sheet conveyance direction, unlike the upper supply manifold 51 in the present embodiment. In this case, the ink flow resistance is substantially the same among four joint portions of the upper supply manifold 51 at which the upper supply manifold 51 is joined to the respective four lower supply manifolds 41, namely, among four portions of the upper supply manifold 51 that overlap the respective four supply connection openings 46 in the up-down direction. Further, the ink flow resistance is substantially the same among four joint portions of the upper discharge manifold 52 at which the upper discharge manifold 52 is joined to the respective four lower discharge manifolds 42, namely, among four portions of the upper discharge manifold 52 that overlap the respective four discharge connection openings 47 in the up-down direction.

In the above case, there are considered degrees of ease of flow of the ink in the four lower supply manifolds 41 and in the four lower discharge manifolds 42 when the ink is delivered toward the upper supply manifold 51 by the pump 61 connected to the supply opening 56. The degree of ease of flow of the ink from the upper supply manifold 51 into the four lower supply manifolds 41 decreases with an increase in a distance by which each lower supply manifold 41 is distant from the supply opening 56 in the sheet conveyance direction toward the downstream side. In other words, when focusing on any two of the four lower supply manifolds 41, the ink is less prone to flow from the upper supply manifold 51 into one of the two lower supply manifolds 41 than into the other of the two lower supply manifolds 41, the one of the two lower supply manifolds being located more downstream, namely, located farther from the supply opening 56, in the sheet conveyance direction than the other of the two lower supply manifolds 41. This may cause a large difference, among the four lower supply manifolds 41, in the degree of ease of flow of the ink from the upper supply manifold 51. Similarly, the degree of ease of flow of the ink into the upper discharge manifold 52 from the four lower discharge manifolds 42 decreases with an increase in a distance by which each lower discharge manifold 42 is distant from the supply opening 56 in the sheet conveyance direction toward the downstream side. In other words, when focusing on any two of the four lower discharge manifolds 42, the ink is less prone to flow into the upper discharge manifold 52 from one of the two lower discharge manifolds 42 than from the other of the two lower discharge manifolds 42, the one of the two lower discharge manifolds 42 being located more downstream, namely, located farther from the supply opening 56, in the sheet conveyance direction than the other of the two lower discharge manifolds 42. This may cause a large difference, among the four lower discharge manifolds 42, in the degree of ease of flow of the ink into the upper discharge manifold 52.

In the present embodiment, therefore, the upper supply manifold 51 is constructed such that the dimension thereof in the sheet width direction increases toward the downstream side in the sheet conveyance direction, whereby the cross-sectional area thereof on the plane orthogonal to the sheet conveyance direction increases toward the downstream side in the sheet conveyance direction. In other words, the dimension of the upper supply manifold 51 in the sheet width direction increases so as to be larger at a portion thereof farther from the supply opening 56 in the sheet conveyance direction (as one example of "second portion of the second supply passage") than at a portion thereof closer to the supply opening 56 in the sheet conveyance direction (as one example of "first portion of the second supply passage"), whereby the cross-sectional area of the upper supply manifold 51 increases so as to be larger at the portion farther from the supply opening 56 in the sheet conveyance direction than at the portion closer to the supply opening 56 in the sheet conveyance direction. In other words, the cross-sectional area of the second supply passage at the first portion differs from the cross-sectional area of the second supply passage at the second portion. In the thus constructed upper supply manifold 51, the ink flow resistance at four joint portions thereof (at which the upper supply manifold 51 is joined to the respective four lower supply manifolds 41) decreases with an increase in a distance by which each joint portion is distant from the supply opening 56 in the sheet conveyance direction toward the downstream side. As a result, the degree of ease of flow of the ink from the upper supply manifold 51 can be made uniform among the lower supply manifolds 41.

Further, in the present embodiment, the upper discharge manifold 52 is constructed such that the dimension thereof in the sheet width direction increases toward the downstream side in the sheet conveyance direction, whereby the cross-sectional area thereof on the plane orthogonal to the sheet conveyance direction increases toward the downstream side in the sheet conveyance direction. In other words, the dimension of the upper discharge manifold 52 in the sheet width direction increases so as to be larger at a portion thereof farther from the supply opening 56 in the sheet conveyance direction (as one example of "second portion of the second discharge passage") than at a portion thereof closer to the supply opening 56 in the sheet conveyance direction (as one example of "first portion of the second discharge passage"), whereby the cross-sectional area of the upper discharge manifold 52 increases so as to be larger at the portion farther from the supply opening 56 in the sheet conveyance direction than at the portion closer to the supply opening 56 in the sheet conveyance direction. In other words, the cross-sectional area of the second discharge passage at the first portion differs from the cross-sectional area of the second discharge passage at the second portion. In the thus constructed upper discharge manifold 52, the ink flow resistance at four joint portions thereof (at which the upper discharge manifold 52 is joined to the respective four lower discharge manifolds 42) decreases with an increase in a distance by which each joint portion is distant from the supply opening 56 in the sheet conveyance direction toward the downstream side. As a result, the degree of ease of flow of the ink into the upper discharge manifold 52 can be made uniform among the lower discharge manifolds 42.

Accordingly, the configuration described above enables an amount of circulation of the ink to be uniform among the plurality of individual passages 20.

While the embodiment of the present disclosure has been described above, it is to be understood that the present disclosure is not limited to the details of the illustrated embodiment, but may be embodied with various changes without departing from the scope of the disclosure.

In the illustrated embodiment, the upper supply manifold 51 and the upper discharge manifold 52 are constructed such that only the dimensions thereof in the sheet width direction are increased toward the downstream side in the sheet conveyance direction, whereby the respective cross-sectional areas of the upper supply manifold 51 and the upper discharge manifold 52 on the plane orthogonal to the sheet conveyance direction are increased toward the downstream side in the sheet conveyance direction. The present disclosure is not limited to this configuration. For instance, each of the upper supply manifold 51 and the upper discharge manifold 52 may be constructed such that only the dimension thereof in the up-down direction increases toward the downstream side in the sheet conveyance direction or both the dimension thereof in the sheet width direction and the dimension thereof in the up-down direction increase toward the downstream side in the sheet conveyance direction, whereby the cross-sectional area of each of the upper supply manifold 51 and the upper discharge manifold 52 on the plane orthogonal to the sheet conveyance direction may be increased toward the downstream side in the sheet conveyance direction.

In the illustrated embodiment, the upper supply manifold 51 is constructed such that the dimension thereof in the sheet width direction increases toward the downstream side in the sheet conveyance direction, and the upper discharge manifold 52 is constructed such that the dimension thereof in the sheet width direction increases toward the downstream side in the sheet conveyance direction. The present disclosure is not limited to this configuration. For instance, one of the upper supply manifold 51 and the upper discharge manifold 52 may be constructed such that the dimension thereof in the sheet width direction is substantially constant throughout the sheet conveyance direction.

In the illustrated embodiment, the four supply connection openings 46 have the same size, the same shape, and the same cross-sectional area on the plane orthogonal to the up-down direction, and the four discharge connection openings 47 have the same size, the same shape, and the same cross-sectional area on the plane orthogonal to the up-down direction. The present disclosure is not limited to this configuration.

Figure 5:
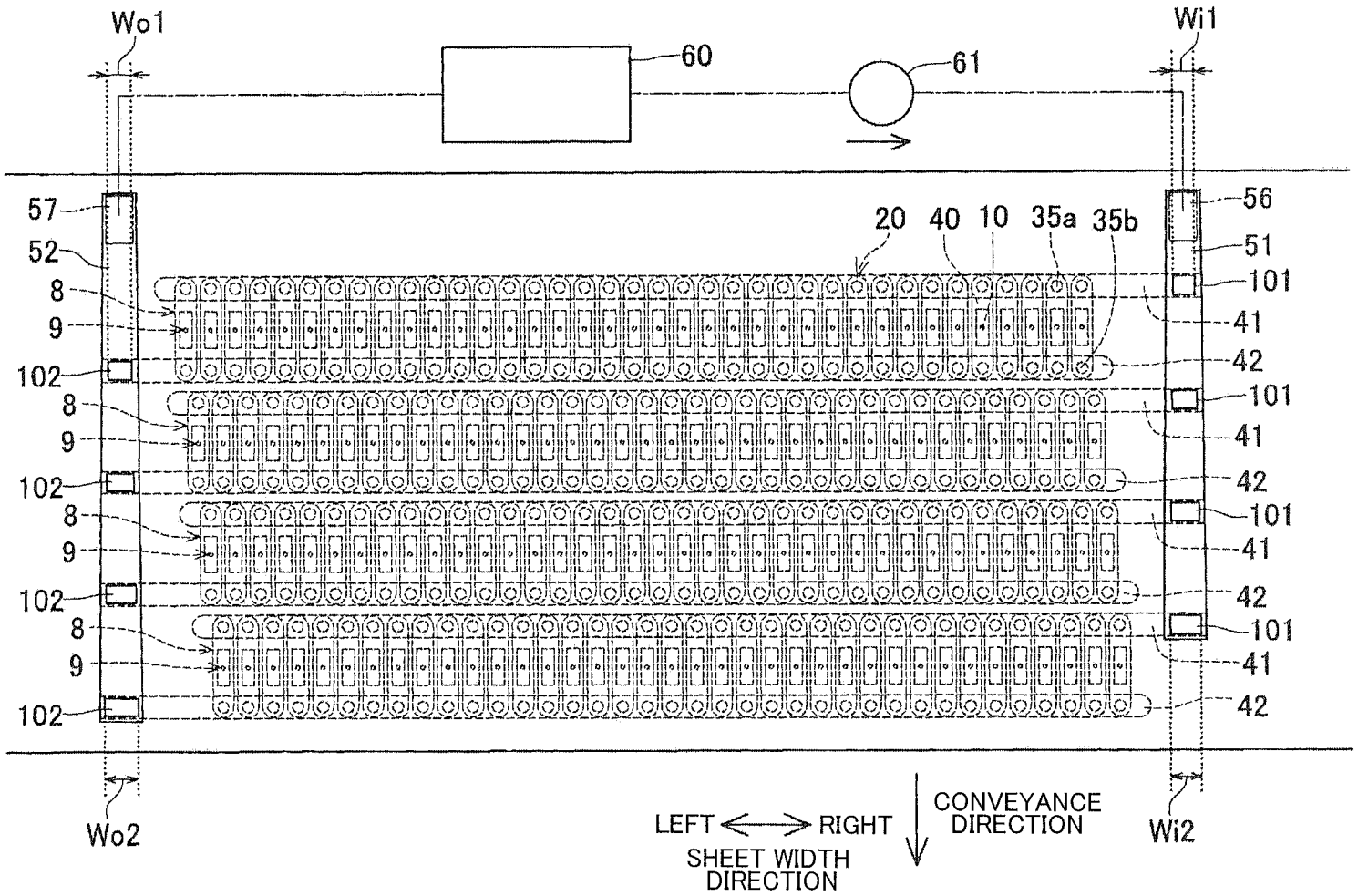
FIG. 5 is a plan view of a head unit according to a first modification, the view corresponding to that of FIG. 2.

In a first modification shown in FIG. 5, the dimensions of four supply connection openings 101 in the sheet width direction increase with an increase in a distance by which each supply connection opening 101 is distant from the supply opening 56 in the sheet conveyance direction toward the downstream side, whereby cross-sectional areas of the respective four supply connection openings 101 on the plane orthogonal to the up-down direction accordingly increase. In other words, when focusing on any two of the four supply connection openings 101, one of the two supply connection openings 101 has the dimension in the sheet width direction larger than that of the other of the two supply connection openings 101, the one of the two supply connection openings 101 being located more downstream, namely, located farther from the supply opening 56, in the sheet conveyance direction than the other of the two supply connection openings 101. Thus, the one of the two supply connection openings 101 has the cross-sectional area on the plane orthogonal to the up-down direction larger than that of the other of the two supply connection openings 101. For instance, the most downstream one of the four supply connection openings 101 in the sheet conveyance direction has a dimension Wi2 in the sheet width direction that is equal to about 0.6 mm whereas the most upstream one of the four supply connection openings 101 in the sheet conveyance direction has a dimension Wi1 in the sheet width direction that is not less than 0.2 mm and not greater than 0.5 mm. Each of the four supply connection openings 101 has a dimension in the sheet conveyance direction that is not less than 0.1 mm and not greater than 1.0 mm.

In the first modification of FIG. 5, the dimensions of four discharge connection openings 102 in the sheet width direction increase with an increase in a distance by which each discharge connection opening 102 is distant from the supply opening 56 in the sheet conveyance direction toward the downstream side, whereby cross-sectional areas of the respective four discharge connection openings 102 on the plane orthogonal to the up-down direction accordingly increase. In other words, when focusing on any two of the four discharge connection openings 102, one of the two discharge connection openings 102 has the dimension in the sheet width direction larger than that of the other of the two discharge connection openings 102, the one of the two discharge connection openings 102 being located more downstream, namely, located farther from the supply opening 56, in the sheet conveyance direction than the other of the two discharge connection openings 102. Thus, the one of the two discharge connection openings 102 has the cross-sectional area on the plane orthogonal to the up-down direction larger than that of the other of the two discharge connection openings 102. For instance, the most downstream one of the four discharge connection openings 102 in the sheet conveyance direction has a dimension Wo2 in the sheet width direction that is equal to about 0.6 mm whereas the most upstream one of the four discharge connection openings 102 in the sheet conveyance direction has a dimension Wo1 in the sheet width direction that is not less than 0.2 mm and not greater than 0.5 mm Each of the four discharge connection openings 102 has a dimension in the sheet conveyance direction that is not less than 0.1 mm and not greater than 1.0 mm.

In the first modification, the dimensions of the four supply connection openings 101 in the sheet width direction increase with an increase in the distance by which each supply connection opening 101 is distant from the supply opening 56 in the sheet conveyance direction toward the downstream side, whereby the cross-sectional areas of the four supply connection openings 101 on the plane orthogonal to the up-down direction accordingly increase. According to this configuration, the ink flow resistance in the four supply connection openings 101 decreases with an increase in the distance by which each supply connection opening 101 is distant from the supply opening 56 in the sheet conveyance direction toward the downstream side. As a result, the degree of ease of flow of the ink from the upper supply manifold 51 into the four lower supply manifolds 41 can be made uniform among the four lower supply manifolds 41.

In the first modification, the dimensions of the four discharge connection openings 102 in the sheet width direction increase with an increase in the distance by which each discharge connection opening 102 is distant from the supply opening 56 in the sheet conveyance direction toward the downstream side, whereby the cross-sectional areas of the four discharge connection openings 102 on the plane orthogonal to the up-down direction accordingly increase. According to this configuration, the ink flow resistances in the four discharge connection openings 102 decrease with an increase in the distance by which each discharge connection opening 102 is distant from the supply opening 56 in the sheet conveyance direction toward the downstream side. As a result, the degree of ease of flow of the ink into the upper discharge manifold 52 from the four lower discharge manifolds 42 can be made uniform among the four lower discharge manifolds 42.

In the first modification, both the supply connection openings 101 and the discharge connection openings 102 are constructed such that the supply connection openings 101 and the discharge connection openings 102 located more downstream have larger dimensions in the sheet width direction so as to have larger cross-sectional areas on the plane orthogonal to the up-down direction. The present disclosure is not limited to this configuration. For instance, only the four supply connection openings 101 or only the four discharge connection openings 102 may have a constant dimension in the sheet width direction.

In the first modification, the dimension of the supply connection openings 101 in the sheet width direction and the dimension of the discharge connection openings 102 in the sheet width direction are not limited to those described above. For instance, the dimension Wi2 in the sheet width direction of the most downstream supply connection opening 101 in the sheet conveyance direction may be greater than or less than 0.6 mm. Further, the dimension Wi1 in the sheet width direction of the most upstream supply connection opening 101 in the sheet conveyance direction may be less than 0.2 mm or greater than 0.5 mm provided that the dimension Wi1 is less than the dimension Wi2. Similarly, the dimension Wo2 in the sheet width direction of the most downstream discharge connection opening 102 in the sheet conveyance direction may be greater than or less than 0.6 mm. Further, the dimension Wo1 in the sheet width direction of the most upstream discharge connection opening 102 in the sheet conveyance direction may be less than 0.2 mm or greater than 0.5 mm provided that the dimension Wo1 is less than the dimension Wo2.

In the first modification, only the dimension in the sheet width direction of the supply connection openings 101 and only the dimension in the sheet width direction of the discharge connection openings 102 are changed so as to change the cross-sectional areas thereof on the plane orthogonal to the up-down direction. The present disclosure is not limited to this configuration. Only the dimension in the sheet conveyance direction of the supply connection openings 101 and only the dimension in the sheet conveyance direction of the discharge connection openings 102 may be changed so as to change the cross-sectional areas thereof on the plane. Alternatively, both the dimension in the sheet width direction and the dimension in the sheet conveyance direction of the supply connection openings 101 and both the dimension in the sheet width direction and the dimension in the sheet conveyance direction of the discharge connection openings 102 may be changed so as to change the cross-sectional areas thereof on the plane.

In the illustrated embodiment, each lower supply manifold 41 has the dimension in the sheet conveyance direction that is substantially constant throughout the sheet width direction, and each lower discharge manifold 42 has the dimension in the sheet conveyance direction that is substantially constant throughout the sheet width direction. The present disclosure is not limited to this configuration.

Figure 6:
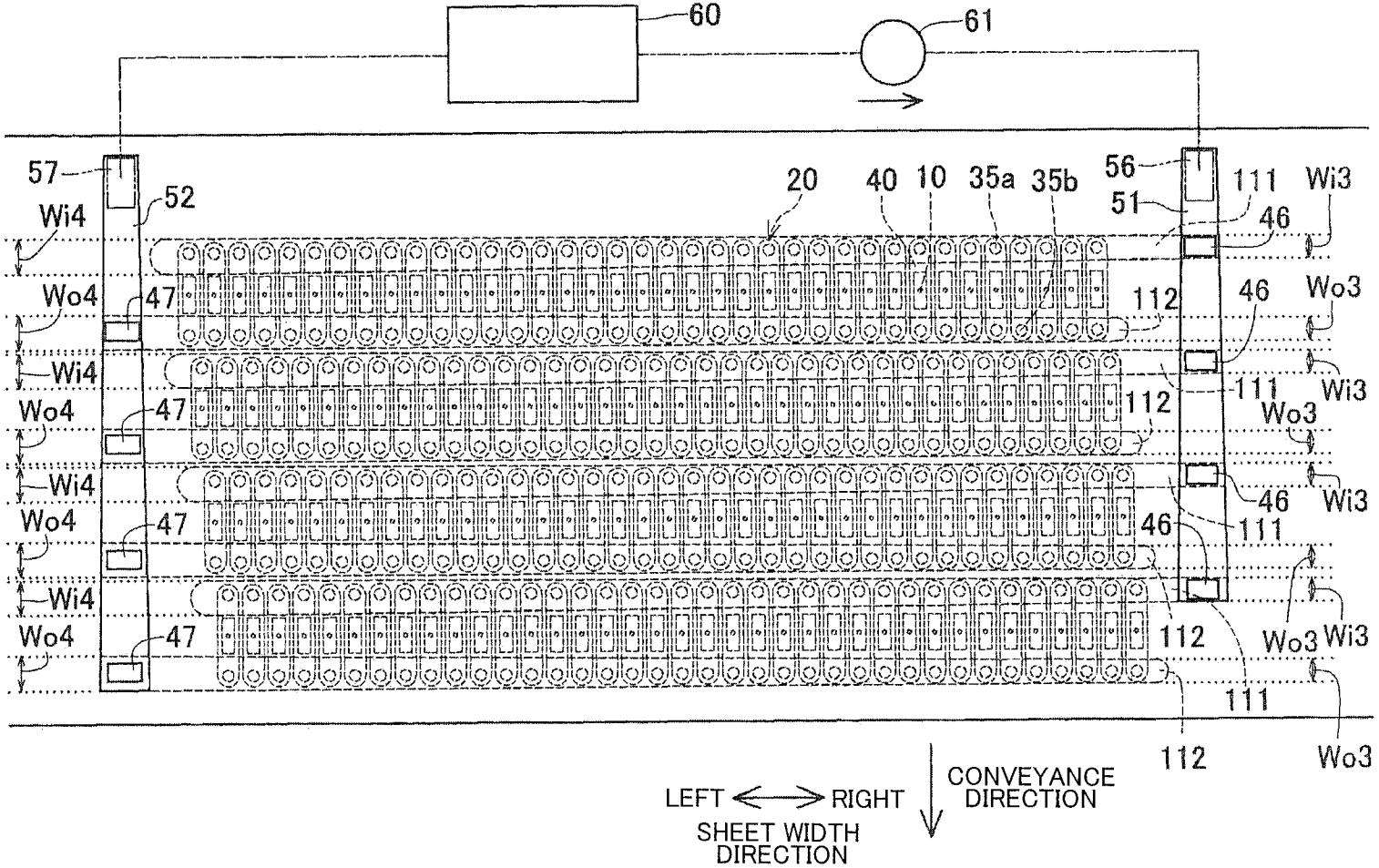
FIG. 6 is a plan view of a head unit according to a second modification, the view corresponding to that of FIG. 2.

In a second modification shown in FIG. 6, each lower supply manifold 111 is constructed such that its dimension in the sheet conveyance direction gradually increases toward the left side in the sheet width direction away from the corresponding supply connection opening 46, whereby a cross-sectional area of each lower supply manifold 111 on a plane orthogonal to the sheet width direction gradually increases toward the left side in the sheet width direction away from the corresponding supply connection opening 46. In other words, each lower supply manifold 111 has the dimension in the sheet conveyance direction that increases so as to be larger at a portion of each lower supply manifold 111 farther from the corresponding supply connection opening 46 in the sheet width direction (as one example of "second portion of the first supply passage") than at a portion thereof closer to the corresponding supply connection opening 46 in the sheet width direction (as one example of "first portion of the first supply passage"), whereby the cross-sectional area of each lower supply manifold 111 on the plane increases so as to be larger at the portion thereof farther from the corresponding supply connection opening 46 in the sheet width direction than at the portion thereof closer to the corresponding supply connection opening 46 in the sheet width direction. In other words, the cross-sectional area of each of the first supply passages at the first portion differs from the cross-sectional area of each of the first supply passages at the second portion. For instance, the dimension in the sheet conveyance direction at each portion of the lower supply manifold 111 falls within a range from not less than 0.5 mm to not greater than 1.0 mm. Specifically, each lower supply manifold 111 has a dimension Wi3 in the sheet conveyance direction at a right end thereof in the sheet width direction that is equal to about 0.5 mm and a dimension Wi4 in the sheet conveyance direction at a left end thereof in the sheet width direction that is equal to about 1.0 mm.

Similarly, each lower discharge manifold 112 is constructed such that its dimension in the sheet conveyance direction gradually increases toward the left side in the sheet width direction away from the corresponding supply connection opening 46, whereby a cross-sectional area of each lower discharge manifold 112 on the plane orthogonal to the sheet width direction gradually increases toward the left side in the sheet width direction away from the corresponding supply connection opening 46. In other words, each lower discharge manifold 112 has the dimension in the sheet conveyance direction that increases so as to be larger at a portion of each lower discharge manifold 112 farther from the corresponding supply connection opening 46 in the sheet width direction (as one example of "second portion of the first discharge passage") than at a portion thereof closer to the corresponding supply connection opening 46 in the sheet width direction (as one example of "first portion of the first discharge passage"), whereby the cross-sectional area of each lower discharge manifold 112 on the plane increases so as to be larger at the portion thereof farther from the corresponding supply connection opening 46 in the sheet width direction than at the portion thereof closer to the corresponding supply connection opening 46 in the sheet width direction. In other words, the cross-sectional area of each of the first discharge passages at the first portion differs from the cross-sectional area of each of the first discharge passages at the second portion. Here, the corresponding supply connection opening 46 refers to one supply connection opening 46 from which the ink that flows through the lower discharge manifold 112 in question is supplied. For instance, the dimension in the sheet conveyance direction at each portion of the lower discharge manifold 112 falls within a range from not less than 0.5 mm to not greater than 1.0 mm Specifically, each lower discharge manifold 112 has a dimension Wo3 in the sheet conveyance direction at a right end thereof in the sheet width direction that is equal to about 0.5 mm and a dimension Wo4 in the sheet conveyance direction at a left end thereof in the sheet width direction that is equal to about 1.0 mm.

Here, a case is considered in which the ink flow resistance is uniform among a plurality of joint portions of each lower supply manifold 111 at which the lower supply manifold 111 is connected to the respective supply orifices 35*a*, in contrast to the second modification. In this case, when the ink is delivered toward the upper supply manifold 51 by the pump 61 connected to the supply opening 56, the ink is less prone to flow into the individual passages 20 (the supply orifices 35*a*) from the corresponding lower supply manifold 111 with an increase in a distance by which each individual passage 20 (each supply orifice 35*a*) is distant from the corresponding supply connection opening 46 in the sheet width direction. Similarly, a case is considered in which the ink flow resistance is uniform at a plurality of joint portions of each lower discharge manifold 112 at which the lower discharge manifold 112 is connected to the respective discharge orifices 35*b*, in contrast to the second modification.

In this case, the ink is less prone to flow from the individual passages 20 (the discharge orifices 35*b*) into the corresponding lower discharge manifold 112 with an increase in a distance by which each individual passage 20 (each discharge orifice 35*b*) is distant from the corresponding supply connection opening 46 in the sheet width direction.

In the second modification, the dimension in the sheet conveyance direction of each lower supply manifold 111 increases toward the left side in the sheet width direction away from the corresponding supply connection opening 46, whereby the cross-sectional area of the lower supply manifold 111 on the plane orthogonal to the sheet width direction increases toward the left side in the sheet width direction away from the corresponding supply connection opening 46. According to this configuration, the ink flow resistance at the joint portions of each lower supply manifold 111 to the respective supply orifices 35*a* decreases with an increase in the distance by which each joint portion is distant from the corresponding supply connection opening 46 in the sheet width direction. As a result, the degree of ease of flow of the ink from each lower supply manifold 111 can be made uniform among the corresponding individual passages 20.

In the second modification, the dimension in the sheet conveyance direction of each lower discharge manifold 112 increases toward the left side in the sheet width direction away from the corresponding supply connection opening 46, whereby the cross-sectional area of the lower discharge manifold 112 on the plane orthogonal to the sheet width direction increases toward the left side in the sheet width direction away from the corresponding supply connection opening 46. According to this configuration, the ink flow resistance at the joint portions of each lower discharge manifold 112 to the respective discharge orifices 35*b* decreases with an increase in the distance by which each joint portion is distant from the corresponding supply connection opening 46 in the sheet width direction. As a result, the degree of ease of flow of the ink into each lower discharge manifold 112 can be made uniform among the corresponding individual passages 20.

In the second modification, the dimension in the sheet conveyance direction at each portion of the lower supply manifold 111 and the dimension in the sheet conveyance direction at each portion of the lower discharge manifold 112 both fall within the range from not less than 0.5 mm to not greater than 1.0 mm. The present disclosure is not limited to this configuration. In each of the lower supply manifolds 111 and the lower discharge manifolds 112, the smallest dimension in the sheet conveyance direction may be less than 0.5 mm, and the largest dimension in the sheet conveyance direction may be greater than 1.0 mm.

In the second modification, only the dimension in the sheet conveyance direction of each lower supply manifold 111 and only the dimension in the sheet conveyance direction of each lower discharge manifold 112 are changed, whereby the cross-sectional areas thereof on the plane orthogonal to the sheet width direction are changed. The present disclosure is not limited to this configuration. The cross-sectional areas of each lower supply manifold 111 and each lower discharge manifold 112 may be changed by changing only the dimension in the up-down direction or by changing both the dimension in the sheet conveyance direction and the dimension in the up-down direction.

In the second modification, the dimension in the sheet conveyance direction increases toward the left side in the sheet width direction for both the lower supply manifolds 111 and the lower discharge manifolds 112. The present disclosure is not limited to this configuration. Only one of: the lower supply manifolds 111; and the lower discharge manifolds 112 may have the dimension in the sheet conveyance direction that is substantially constant throughout the sheet width direction.

In the illustrated embodiment, the supply opening 56 is connected to the upstream end of the upper supply manifold 51 in the sheet conveyance direction, and the discharge opening 57 is connected to the upstream end of the upper discharge manifold 52 in the sheet conveyance direction. That is, the supply opening 56 and the discharge opening 57 are respectively connected to the upper supply manifold 51 and the upper discharge manifold 52 on the same side, i.e., on the upstream side, in the sheet conveyance direction. The present disclosure is not limited to this configuration.

Figure 7:
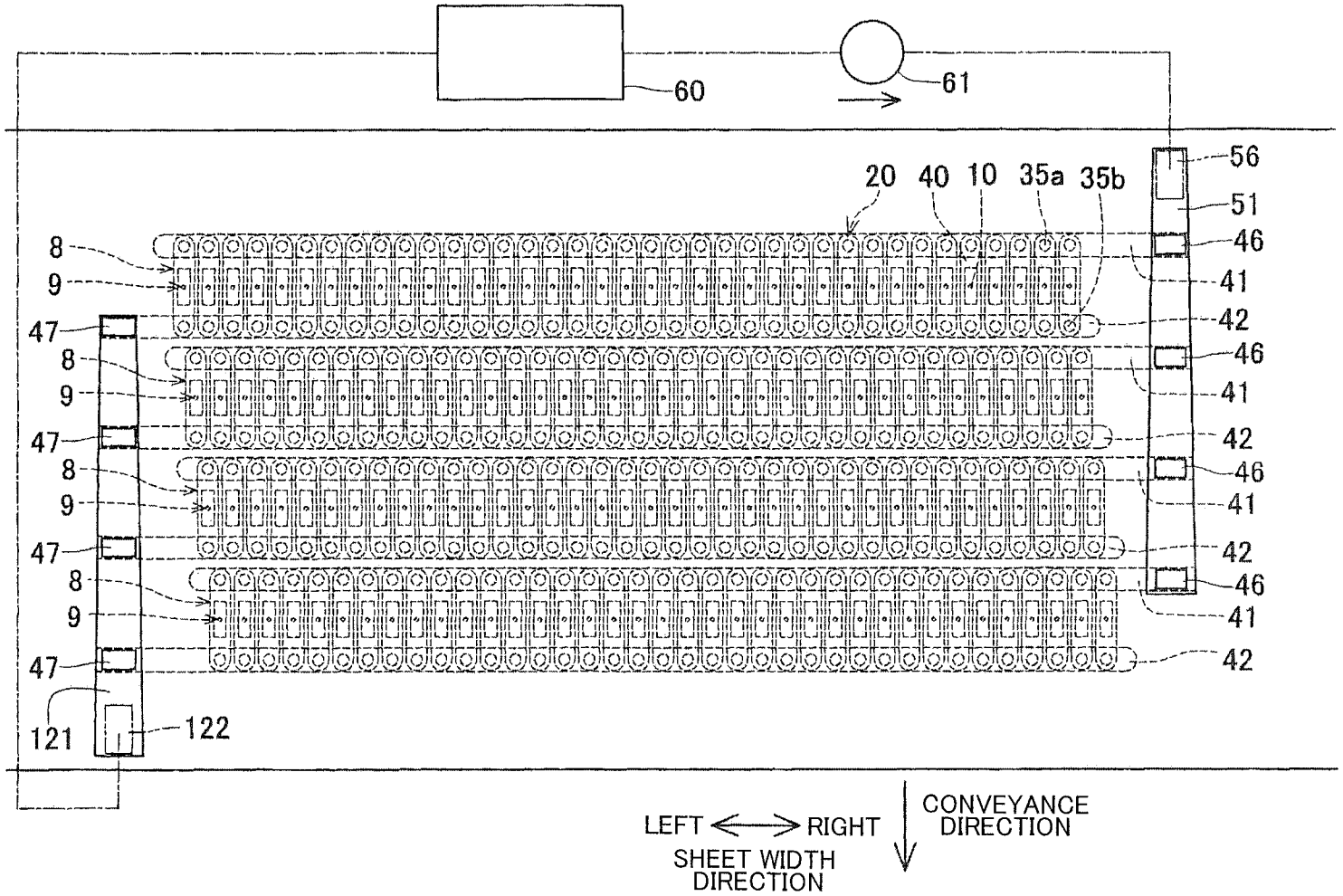
FIG. 7 is a plan view of a head unit according to a third modification, the view corresponding to that of FIG. 2.

In a third modification shown in FIG. 7, an upper discharge manifold 121 extends downstream in the sheet conveyance direction beyond a region thereof in which the upper discharge manifold 121 is connected to the four discharge connection openings 47. A discharge opening 122 overlaps, in the up-down direction, a downstream end of the upper discharge manifold 121 in the sheet conveyance direction. The upper discharge manifold 121 has a dimension in the sheet width direction that gradually increases toward the downstream side in the sheet conveyance direction, namely, a dimension in the sheet width direction that gradually increases with an increase in a distance from the supply opening 56 in the sheet conveyance direction, whereby its cross-sectional area on the plane orthogonal to the sheet conveyance direction gradually increases toward the downstream side in the sheet conveyance direction.

According to this configuration, the upper discharge manifold 121 has the dimension in the sheet width direction that increases toward the downstream side in the sheet conveyance direction, whereby its cross-sectional area on the plane orthogonal to the sheet conveyance direction increases toward the downstream side in the sheet conveyance direction. Thus, the degree of ease of flow of the ink into the upper discharge manifold 121 can be made uniform among the four lower discharge manifolds 42.

In the embodiment and the modifications illustrated above, the pump 61 configured to deliver the ink toward the upper supply manifold 51 is disposed in the flow passage between the supply opening 56 and the ink tank 60. The present disclosure is not limited to this configuration.

Figure 8:
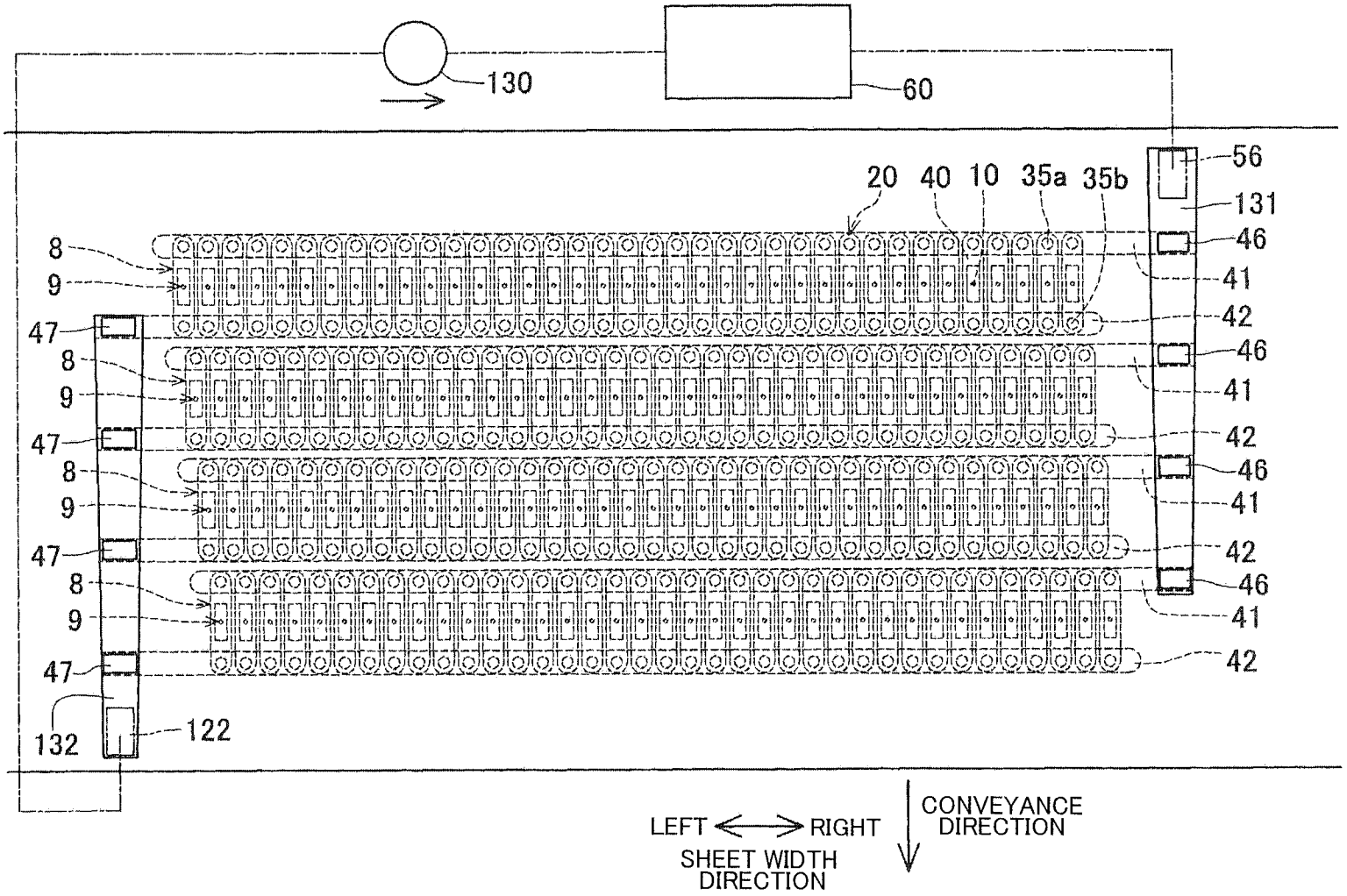
FIG. 8 is a plan view of a head unit according to a fourth modification, the view corresponding to that of FIG. 2.

In a fourth modification shown in FIG. 8, the pump is not disposed between the supply opening 56 and the ink tank 60, in contrast to the third modification. Instead, a pump 130 is disposed in a flow passage between the discharge opening 122 and the ink tank 60. The pump 130 is configured to deliver the ink in a direction from the discharge opening 122 toward the ink tank 60. That is, the pump 130 is configured to deliver the ink in a direction in which the ink is discharged from an upper discharge manifold 132.

In the thus constructed fourth modification, an upper supply manifold 131 has a dimension in the sheet width direction that gradually increases toward the upstream side in the sheet conveyance direction, namely, a dimension in the sheet width direction that gradually increases with an increase in a distance from the discharge opening 122 in the sheet conveyance direction, whereby its cross-sectional area on the plane orthogonal to the sheet conveyance direction gradually increases toward the upstream side in the sheet conveyance direction. In other words, the cross-sectional area of the upper supply manifold 131 increases so as to be larger at a portion thereof farther from the discharge opening 122 in the sheet conveyance direction (as one example of "second portion of the second supply passage") than at a portion thereof closer to the discharge opening 122 in the sheet conveyance direction (as one example of "first portion of the second supply passage"). In other words, the cross-sectional area of the second supply passage at the first portion differs from the cross-sectional area of the second supply passage at the second portion. Further, an upper discharge manifold 132 has a dimension in the sheet width direction that gradually increases toward the upstream side in the sheet conveyance direction, namely, a dimension in the sheet width direction that gradually increases with an increase in a distance from the discharge opening 122 in the sheet conveyance direction, whereby its cross-sectional area on the plane orthogonal to the sheet conveyance direction gradually increases toward the upstream side in the sheet conveyance direction. In other words, the cross-sectional area of the upper discharge manifold 132 increases so as to be larger at a portion thereof farther from the discharge opening 122 in the sheet conveyance direction (as one example of "second portion of the second supply passage") than at a portion thereof closer to the discharge opening 122 in the sheet conveyance direction ((as one example of "first portion of the second supply passage"). In other words, the cross-sectional area of the second discharge passage at the first portion differs from the cross-sectional area of the second discharge passage at the second portion.

Here, a case is considered in which the dimension in the sheet width direction of the upper supply manifold 131 and the dimension in the sheet width direction of the upper discharge manifold 132 are substantially constant throughout the sheet conveyance direction, in contrast to the fourth modification. In this case, the ink flow resistance is substantially the same among four joint portions of the upper supply manifold 131 at which the upper supply manifold 131 is joined to the respective four lower supply manifolds 41, namely, among four portions of the upper supply manifold 131 that overlap the respective supply connection openings 46 in the up-down direction. Further, the ink flow resistance is substantially the same among four joint portions of the upper discharge manifold 132 at which the upper discharge manifold 132 is joined to the respective lower discharge manifolds 42, namely, among four portions of the upper discharge manifold 132 that overlap the respective four supply connection openings 46 in the up-down direction.

In the above case, there are considered degrees of ease of flow of the ink in the four lower supply manifolds 41 and in the four lower discharge manifolds 42 when the ink is delivered by the pump 130 connected to the discharge opening 122 in the direction in which the ink is discharged from the upper discharge manifold 132. The degree of ease of flow of the ink from the upper supply manifold 131 into the four lower supply manifolds 41 decreases with an increase in a distance by which each lower supply manifold 41 is distant from the discharge opening 122 in the sheet conveyance direction toward the upstream side. In other words, when focusing on any two of the four lower supply manifolds 41, the ink is less prone to flow from the upper supply manifold 131 into one of the two lower supply manifolds 41 than into the other of the two lower supply manifolds 41, the one of the two lower supply manifolds 41 being located more upstream, namely, located farther from the discharge opening 122, in the sheet conveyance direction than the other of the two lower supply manifolds 41. This may cause a large difference, among the four lower supply manifolds 41, in the degree of ease of flow of the ink from the upper supply manifold 131. Similarly, the degree of ease of flow of the ink into the upper discharge manifold 132 from the four lower discharge manifolds 42 decreases with an increase in a distance by which each lower discharge manifold 42 is distant from the discharge opening 122 in the sheet conveyance direction toward the upstream side. In other words, when focusing on any two of the four lower discharge manifolds 42, the ink is less prone to flow into the upper discharge manifold 132 from one of the two lower discharge manifolds 42 than from the other of the two lower discharge manifolds 42, the one of the two lower discharge manifolds 42 being located more upstream, namely, located farther from the discharge opening 122, in the sheet conveyance direction than the other of the two lower discharge manifolds 42. This may cause a large difference, among the four lower discharge manifolds 42, in the degree of ease of flow of the ink into the upper discharge manifold 132.

In the fourth modification, therefore, the upper supply manifold 131 is constructed such that the dimension thereof in the sheet width direction increases toward the upstream side in the sheet conveyance direction, whereby the cross-sectional area thereof on the plane orthogonal to the sheet conveyance direction increases toward the upstream side in the sheet conveyance direction. In the thus constructed upper supply manifold 131, the ink flow resistance at the four joint portions thereof (at which the upper supply manifold 131 is joined to the respective four lower supply manifolds 41) decreases with an increase in the distance by which each joint portion is distant from the discharge opening 122 in the sheet conveyance direction toward the upstream side. As a result, the degree of ease of flow of the ink from the upper supply manifold 51 can be made uniform among the four lower supply manifolds 41.

Further, in the fourth modification, the upper discharge manifold 132 is constructed such that the dimension thereof in the sheet width direction increases toward the upstream side in the sheet conveyance direction, whereby the cross-sectional area thereof on the plane orthogonal to the sheet conveyance direction increases toward the upstream side in the sheet conveyance direction. In the thus constructed upper discharge manifold 132, the ink flow resistance at the four joint portions thereof (at which the upper discharge manifold 132 is joined to the respective four lower discharge manifolds 42) decreases with an increase in the distance by which each joint portion is distant from the discharge opening 122 in the sheet conveyance direction toward the upstream side. As a result, the degree of ease of flow of the ink into the upper discharge manifold 132 can be made uniform among the four lower discharge manifolds 42.

Accordingly, the configuration described above enables an amount of circulation of the ink to be uniform among the plurality of individual passages 20.

In the embodiment and the modifications illustrated above, the pump is disposed in one of: the flow passage between the ink tank and the supply opening; and the ink passage between the ink tank and the discharge opening. The present disclosure is not limited to this configuration. For instance, the pump may be disposed in each of those flow passages.

In this case, depending on a relationship between amounts of the ink delivered from the respective two pumps per unit time, an ink flow resistance distribution at each portion in the flow passages in the head unit 11, etc., the upper supply manifold and/or the upper discharge manifold is constructed such that the cross-sectional area thereof on the plane orthogonal to the sheet conveyance direction increases with an increase in the distance from the supply opening in the sheet conveyance direction or such that the cross-sectional area thereof on the plane orthogonal to the sheet conveyance direction increases with an increase in the distance from the discharge opening in the sheet conveyance direction, as in the illustrated embodiment and the first through third modifications. Accordingly, the configuration enables an amount of circulation of the ink to be uniform among the plurality of individual passages 20.

Also in the case where the pump is disposed in one of: the flow passage between the ink tank and the supply opening; and the flow passage between the ink tank and the discharge opening, the upper supply manifold and/or the upper discharge manifold may be constructed as described above depending on the ink flow resistance at each portion in the flow passages in the head unit 11. That is, the upper supply manifold and/or the upper discharge manifold may be constructed such that the cross-sectional area thereof on the plane orthogonal to the sheet conveyance direction increases with an increase in the distance from the supply opening in the sheet conveyance direction or such that the cross-sectional area thereof on the plane orthogonal to the sheet conveyance direction increases with an increase in the distance from the discharge opening in the sheet conveyance direction.

In the embodiment and the modifications illustrated above, the upper supply manifold and/or the upper discharge manifold is constructed such that the cross-sectional area thereof on the plane orthogonal to the sheet conveyance direction increases or decreases with an increase in the distance from the supply opening in the sheet conveyance direction. The present disclosure is not limited to this configuration. For instance, the upper supply manifold may have mutually different dimensions in the sheet width direction at only at least two portions thereof that overlap, in the up-down direction, the corresponding at least two of the supply connection openings. In this case, the dimension in the sheet width direction at other portion except the at least two portions may be substantially constant. Similarly, the upper discharge manifold may have mutually different dimensions in the sheet width direction at only at least two portions thereof that overlap, in the up-down direction, the corresponding at least two of the discharge connection openings. In this case, the dimension in the sheet width direction at other portion except the at least two portions may be substantially constant.

In the embodiment and modifications illustrated above, the cross-sectional area of each of the upper supply manifold and the upper discharge manifold on the plane orthogonal to the sheet conveyance direction is changed in accordance with the distance from the supply opening or the discharge opening in the sheet conveyance direction. The present disclosure is not limited to this configuration.

Figure 9:
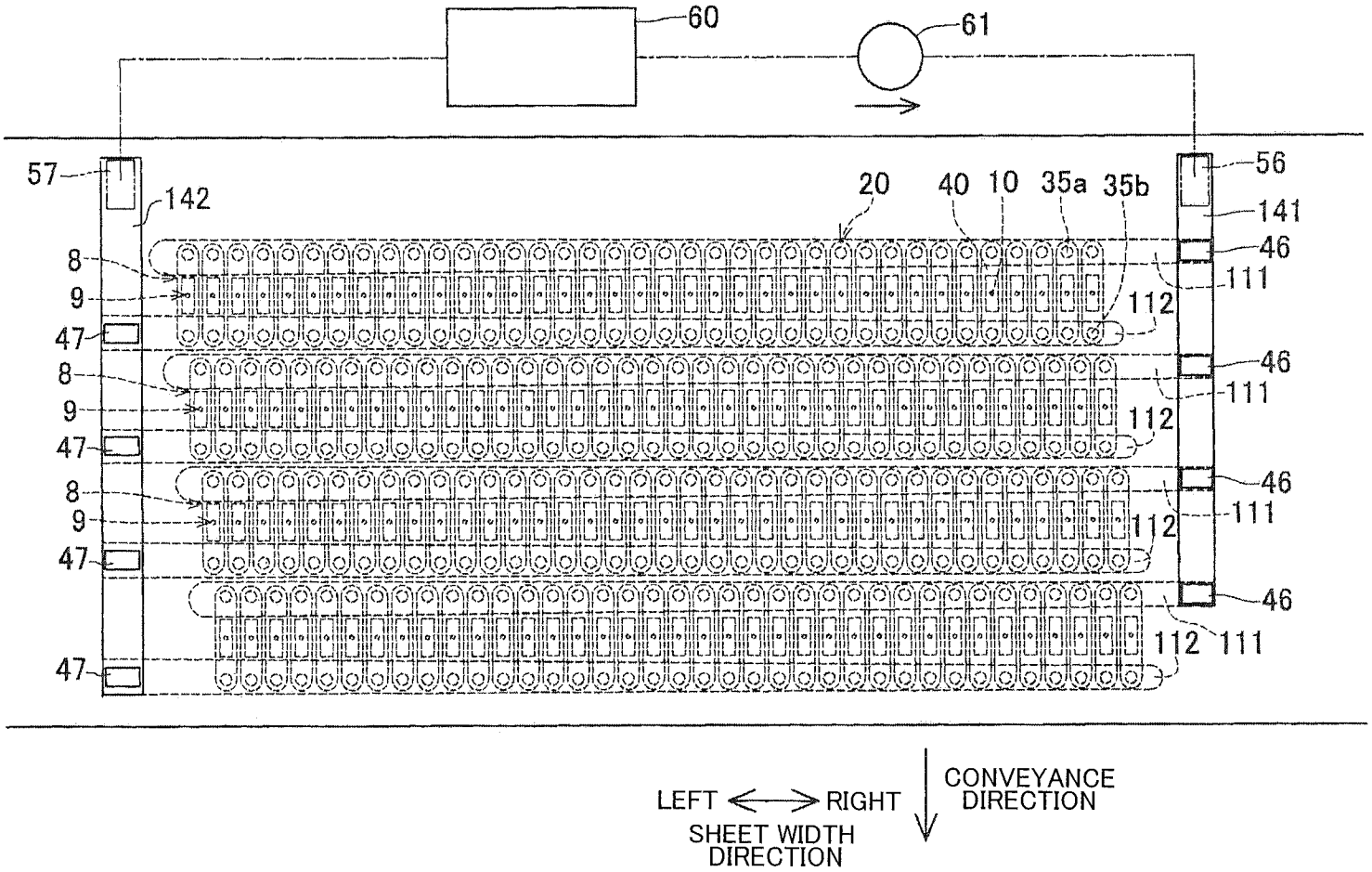
FIG. 9 is a plan view of a head unit according to a fifth modification, the view corresponding to that of FIG. 2.

A fifth modification shown in FIG. 9 differs from the second modification in that each of an upper supply manifold 141 and an upper discharge manifold 142 has a dimension in the sheet width direction that is substantially constant, namely, a cross-sectional area on the plane orthogonal to the sheet conveyance direction that is substantially constant.

In the fifth modification, the cross-sectional area of each of lower supply manifolds 111 on the plane orthogonal to the sheet width direction gradually increases toward the left side in the sheet width direction away from the corresponding supply connection opening 46. In other words, the cross-sectional area of each lower supply manifold 111 increases so as to be larger at a portion thereof farther from the corresponding supply connection opening 46 in the sheet width direction (as one example of "second portion of the first supply passage") than at a portion thereof closer to the corresponding supply connection opening 46 in the sheet width direction (as one example of "first portion of the first supply passage"). In other words, the cross-sectional area of each of the first supply passages at the first portion differs from the cross-sectional area of each of the first supply passages at the second portion. Thus, the degree of ease of flow of the ink from each lower supply manifold 111 can be made uniform among the corresponding individual passages 20.

In the fifth modification, the cross-sectional area of each of lower discharge manifolds 112 on the plane orthogonal to the sheet width direction gradually increases toward the left side in the sheet width direction away from the corresponding supply connection opening 46. In other words, the cross-sectional area of each lower discharge manifold 112 increases so as to be larger at a portion thereof farther from the corresponding supply connection opening 46 in the sheet width direction (as one example of "second portion of the first discharge passage") than at a portion thereof closer to the corresponding supply connection opening 46 in the sheet width direction (as one example of "first portion of the first discharge passage"). In other words, the cross-sectional area of each of the first discharge passages at the first portion differs from the cross-sectional area of each of the first discharge passages at the second portion. Thus, the degree of ease of flow of the ink into each lower discharge manifold 112 can be made uniform among the corresponding individual passages 20.

In the fifth modification, only one of: the lower supply manifolds 111; and the lower discharge manifolds 112 may have the dimension in the sheet conveyance direction that is substantially constant throughout the sheet width direction.

Figure 10:
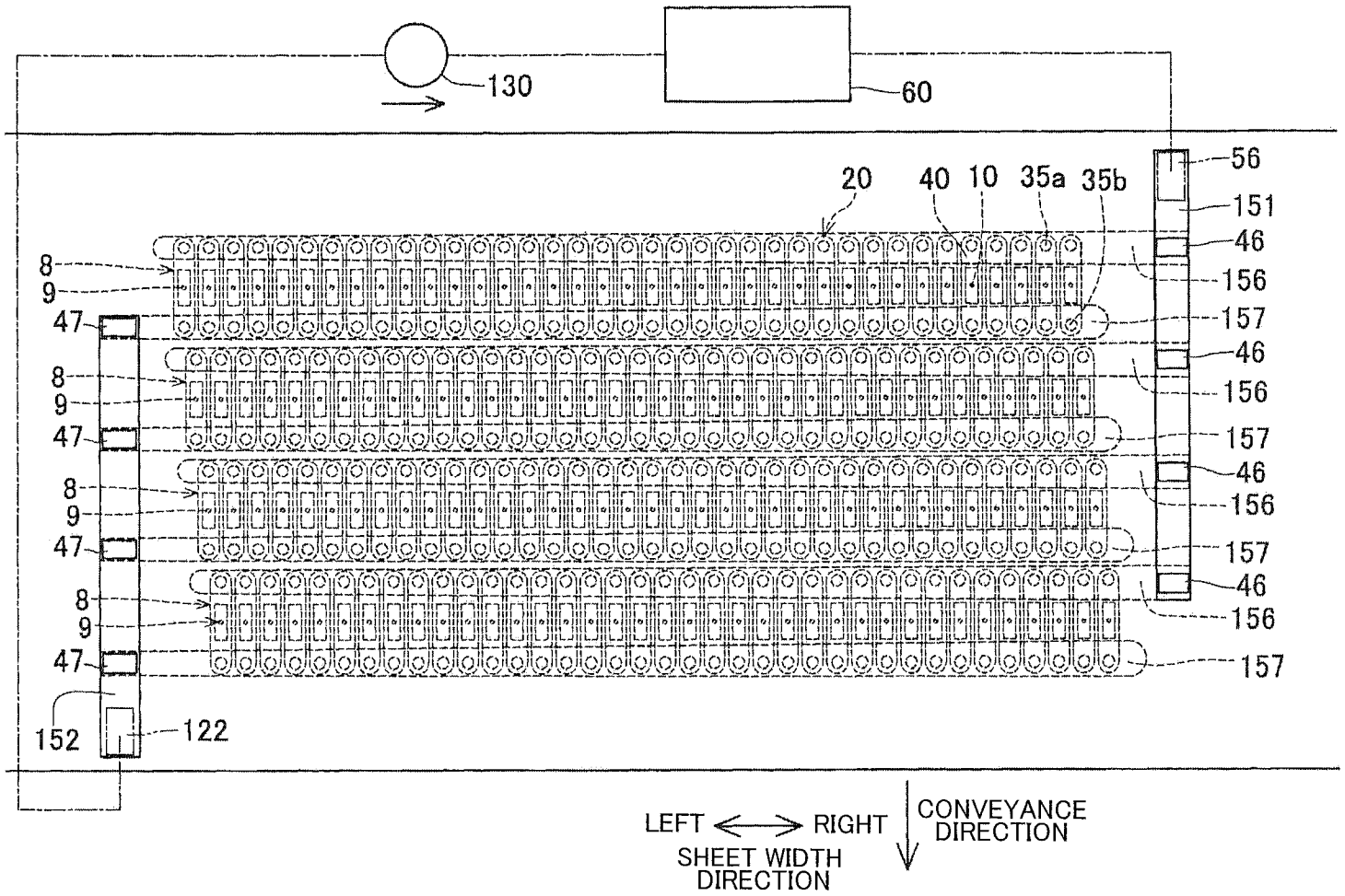
FIG. 10 is a plan view of a head unit according to a sixth modification, the view corresponding to that of FIG. 2.

A sixth modification shown in FIG. 10 differs from the fourth modification in that each of an upper supply manifold 151 and an upper discharge manifold 152 has a dimension in the sheet width direction that is substantially constant throughout the sheet conveyance direction. The sixth modification further differs from the fourth modification in that each of lower supply manifolds 156 and each of lower discharge manifolds 157 have a dimension in the sheet conveyance direction that gradually increases toward the right side in the sheet width direction away from the corresponding discharge connection opening 47, whereby a cross-sectional area of each lower supply manifold 156 and a cross-sectional area of each lower discharge manifold 157 on the plane orthogonal to the sheet width direction gradually increase toward the right side in the sheet width direction away from the corresponding discharge connection opening 47. Here, the corresponding discharge connection opening 47 refers to one discharge connection opening 47 into which the ink that flows through the lower discharge manifold 157 in question is discharged.

In the sixth modification, the cross-sectional area of each lower supply manifold 156 on the plane orthogonal to the sheet width direction increases toward the right side in the sheet width direction away from the corresponding discharge connection opening 47. In other words, the cross-sectional area of each lower supply manifold 156 increases so as to be larger at a portion thereof farther from the corresponding discharge connection opening 47 in the sheet width direction (as one example of "second portion of the first supply passage") than at a portion thereof closer to the corresponding discharge connection opening 47 in the sheet width direction (as one example of "first portion of the first supply passage"). In other words, the cross-sectional area of each of the first supply passages at the first portion differs from the cross-sectional area of each of the first supply passages at the second portion. Thus, the degree of ease of flow of the ink from each lower supply manifold 156 can be made uniform among the corresponding individual passages 20.

In the sixth modification, the cross-sectional area of each lower discharge manifold 157 on the plane orthogonal to the sheet width direction increases toward the right side in the sheet width direction away from the corresponding discharge connection opening 47. In other words, the cross-sectional area of each lower discharge manifold 157 increases so as to be larger at a portion thereof farther from the corresponding discharge connection opening 47 in the sheet width direction (as one example of "second portion of the first discharge passage") than at a portion thereof closer to the corresponding discharge connection opening 47 in the sheet width direction (as one example of "first portion of the first discharge passage"). In other words, the cross-sectional area of each of the first discharge passages at the first portion differs from the cross-sectional area of each of the first discharge passages at the second portion. Thus, the degree of ease of flow of the ink into each lower discharge manifold 157 can be made uniform among the corresponding individual passages 20.

In the sixth modification, only one of: the lower supply manifolds 156; and the lower discharge manifolds 157 may have the dimension in the sheet conveyance direction that is substantially constant throughout the sheet width direction.

In the illustrated embodiment, each supply connection opening 46 overlaps, in the up-down direction, the right end portion of the corresponding lower supply manifold 41, and each discharge connection opening 47 overlaps, in the up-down direction, the left end portion of the corresponding lower discharge manifold 42. The present disclosure is not limited to this configuration. Each supply connection opening 46 may overlap, in the up-down direction, some mid portion of the corresponding lower supply manifold 41 in the sheet width direction, and the corresponding pressure chamber row 8 and the corresponding nozzle row 9 may extend on both sides of the supply connection opening 46 in the sheet width direction. Similarly, each discharge connection opening 47 may overlap, in the up-down direction, some mid portion of the corresponding lower discharge manifold 42 in the sheet width direction, and the corresponding pressure chamber row 8 and the corresponding nozzle row 9 may extend on both sides of the discharge connection opening 47 in the sheet width direction.

In the illustrated embodiment, the lower supply manifolds 41 and the lower discharge manifolds 42 are formed through the single flow-passage plate 36 in the head unit 11. The present disclosure is not limited to this configuration. The lower supply manifolds 41 and the lower discharge manifolds 42 may be formed through two or more flow-passage plates stacked on each other.

In the illustrated embodiment, the upper supply manifold 51 and the upper discharge manifold 52 are formed in the single flow-passage plate 38 in the head unit 11. The present disclosure is not limited to this configuration. The upper supply manifold 51 and the upper discharge manifold 52 may be formed through two or more flow-passage plates stacked on each other.

In the illustrated embodiment, the supply connection openings 46 and the discharge connection openings 47 are formed in the single flow-passage plate 37 in the head unit 11. The present disclosure is not limited to this configuration. The supply connection openings 46 and the discharge connection openings 47 may be formed through two or more flow-passage plates stacked on each other. In this case, as long as each supply connection opening 46 and each discharge connection opening 47 formed through at least one of the two or more flow-passage plates have the respective sizes described above, the size of each supply connection opening 46 may differ among the two or more flow-passage plates and the size of each discharge connection opening 47 may differ among the two or more flow-passage plates.

In the illustrated embodiment, the supply opening 56 and the discharge opening 57 are formed through the single flow-passage plate 39 in the head unit 11. The present disclosure is not limited to this configuration. The supply opening 56 and the discharge opening 57 may be forming through two or more flow-passage plates stacked on each other. In this case, as long as the supply opening 56 and the discharge opening 57 formed through at least one of the two or more flow-passage plates have the respective sizes described above, the size of the supply opening 56 may differ among the two or more flow-passage plates and the size of the discharge opening 57 may differ among the two or more flow-passage plates.

In the illustrated embodiment, the dimension of the upper supply manifold 51 in the sheet width direction continuously increases toward the downstream side in the sheet conveyance direction. The present disclosure is not limited to this configuration. The dimension of the upper supply manifold 51 in the sheet width direction may increase stepwise toward the downstream side in the sheet conveyance direction such that the side walls of the upper supply manifold 51 are shaped like stairs, for instance. In this case, the dimension of the upper supply manifold 51 in the sheet width direction may change in two steps, three steps, or four or more steps.

In the illustrated embodiment, the dimension of the upper discharge manifold 52 in the sheet width direction continuously increases toward the downstream side in the sheet conveyance direction. The present disclosure is not limited to this configuration. The dimension of the upper discharge manifold 52 in the sheet width direction may increase stepwise toward the downstream side in the sheet conveyance direction such that the side walls of the upper discharge manifold 52 are shaped like stairs, for instance. In this case, the dimension of the upper discharge manifold 52 in the sheet width direction may change in two steps, three steps, or four or more steps.

In the embodiment and the modifications illustrated above, the ink flow direction may be inverse. That is, the flow passages used for discharging the ink from the plurality of individual passages 20 into the ink tank 60 may be used as flow passages for supplying the ink from the ink tank 60 into the plurality of individual passages, and the flow passages used for supplying the ink from the ink tank 60 into the plurality of individual passages 20 may be used as flow passages for discharging the ink from the plurality of individual passages 20 into the ink tank 60.

While the present disclosure is applied to the ink jet head configured to eject the ink from the nozzles and the printer including the ink-jet head, the present disclosure may be applied to a liquid ejection head configured to eject, from the nozzles, a liquid other than the ink and a liquid ejection device including such a liquid ejection head.

What is claimed is:

1. A liquid ejection head, comprising:

a plurality of individual passages respectively including nozzles;

a plurality of first supply passages each extending in a first direction so as to be connected to a part of the individual passages, the first supply passages being arranged in a second direction that intersects the first direction, a liquid being supplied to the part of the individual passages through a corresponding one of the first supply passages;

a plurality of first discharge passages each extending in the first direction so as to be connected to a part of the individual passages, the first discharge passages being arranged in the second direction, the liquid being discharged from the part of the individual passages through a corresponding one of the first discharge passages;

a second supply passage extending in the second direction and overlapping the first supply passages in a third direction that intersects a plane parallel to both the first direction and the second direction, the second supply passage communicating with the first supply passages to supply the liquid to the first supply passages, a second discharge passage extending in the second direction and overlapping the first discharge passages in the third direction, the second discharge passage communicating with the first discharge passages to discharge the liquid from the first discharge passages;

wherein, where an area of a cross section of the second supply passage on a plane orthogonal to the second direction is defined as a cross-sectional area of the second supply passage and two portions of the second supply passage spaced apart from each other in the second direction are respectively defined as a first portion and a second portion, (A) the cross-sectional area of the second supply passage at the first portion differs from the cross-sectional area of the second supply passage at the second portion, and/or (B) where an area of a cross section of the second discharge passage on a plane orthogonal to the second direction is defined as a cross-sectional area of the second discharge passage and two portions of the second discharge passage spaced apart from each other in the second direction are respectively defined as a first portion and a second portion, the cross-sectional area of the second discharge passage at the first portion differs from the cross-sectional area of the second discharge passage at the second portion.

2. The liquid ejection head according to claim 1, further comprising a supply opening through which the liquid is supplied to the second supply passage, wherein the first portion of the second supply passage is closer to the supply opening than the second portion of the second supply passage in the second direction, and wherein the cross-sectional area of the second supply passage increases in the second direction so as to be larger at the second portion than at the first portion.

3. The liquid ejection head according to claim 2, wherein the second supply passage has a dimension in the first direction that increases in the second direction so as to be larger at the second portion than at the first portion.

4. The liquid ejection head according to claim 1, further comprising a supply opening through which the liquid is supplied to the second supply passage, wherein the first portion of the second discharge passage is closer to the supply opening than the second portion of the second discharge passage in the second direction, and wherein the cross-sectional area of the second discharge passage increases in the second direction so as to be larger at the second portion than at the first portion.

5. The liquid ejection head according to claim 4, wherein the second discharge passage has a dimension in the first direction that increases in the second direction so as to be larger at the second portion than at the first portion.

6. The liquid ejection head according to claim 1, wherein, where an area of a cross section of each of the first supply passages on a plane orthogonal to the first direction is defined as a cross-sectional area of the first supply passage and two portions of each of the first supply passages spaced apart from each other in the first direction are respectively defined as a first portion and a second portion, the cross-sectional area of each of the first supply passages at the first portion differs from the cross-sectional area of each of the first supply passages at the second portion.

7. The liquid ejection head according to claim 6, further comprising a plurality of supply connection openings each provided between the second supply passage and a corresponding one of the first supply passages in the third direction, each of the supply connection openings connecting the second supply passage and the corresponding one of the first supply passages in the third direction, wherein the first portion of each of the first supply passages is closer to a corresponding one of the supply connection openings than the second portion of each of the first supply passages in the first direction, and wherein the cross-sectional area of each of the first supply passages increases in the first direction so as to be larger at the second portion than at the first portion.

8. The liquid ejection head according to claim 7, wherein each of the first supply passages has a dimension in the second direction that increases in the first direction so as to be larger at the second portion than at the first portion.

9. The liquid ejection head according to claim 8, wherein the dimension in the second direction at each portion of each of the first supply passages falls within a range from not less than 0.5 mm to not greater than 1.0 mm.

10. The liquid ejection head according to claim 1, wherein, where an area of a cross section of each of the first discharge passages on a plane orthogonal to the first direction is defined as a cross-sectional area of the first discharge passage and two portions of each of the first discharge passages spaced apart from each other in the first direction are respectively defined as a first portion and a second portion, the cross-sectional area of each of the first discharge passages at the first portion differs from the cross-sectional area of each of the first discharge passages at the second portion.

11. The liquid ejection head according to claim 10, further comprising a plurality of supply connection openings each provided between the second supply passage and a corresponding one of the first supply passages in the third direction, each of the supply connection openings connecting the second supply passage and the corresponding one of the first supply passages in the third direction, wherein the first portion of each of the first discharge passages is closer to a corresponding one of the supply connection openings than the second portion of each of the first discharge passages in the first direction, and wherein the cross-sectional area of each of the first discharge passages increases in the first direction so as to be larger at the second portion than at the first portion.

12. The liquid ejection head according to claim 10, wherein each of the first discharge passages has a dimension in the second direction that increases in the first direction so as to be larger at the second portion than at the first portion.

13. The liquid ejection head according to claim 11, wherein the dimension in the second direction at each portion of each of the first discharge passages falls within a range from not less than 0.5 mm to not greater than 1.0 mm.

14. The liquid ejection head according to claim 1, further comprising a discharge opening through which the liquid is discharged from the second discharge passage;

wherein the first portion of the second supply passage is closer to the discharge opening than the second portion of the second supply passage in the second direction, and wherein the cross-sectional area of the second supply passage increases in the second direction so as to be larger at the second portion than at the first portion.

15. A liquid ejection device, comprising:

the liquid ejection head according to claim 2; and a pump connected to the second supply passage via the supply opening and configured to deliver the liquid toward the second supply passage.

16. A liquid ejection device, comprising:

the liquid ejection head according to claim 14; and a pump connected to the second discharge passage via the discharge opening and configured to discharge the liquid from the second discharge passage.

17. A liquid ejection head, comprising:

a plurality of individual passages respectively including nozzles;

a plurality of first supply passages each extending in a first direction so as to be connected to a part of the individual passages, the first supply passages being arranged in a second direction that intersects the first direction, a liquid being supplied to the part of the individual passages through a corresponding one of the first supply passages;

a plurality of first discharge passages each extending in the first direction so as to be connected to a part of the individual passages, the first discharge passages being arranged in the second direction, the liquid being discharged from the part of the individual passages through a corresponding one of the first discharge passages;

a second supply passage extending in the second direction and overlapping the first supply passages in a third direction that intersects a plane parallel to both the first direction and the second direction, the second supply passage communicating with the first supply passages to supply the liquid to the first supply passages;

a second discharge passage extending in the second direction and overlapping the first discharge passages in the third direction, the second discharge passage communicating with the first discharge passages to discharge the liquid from the first discharge passages;

a plurality of supply connection openings each provided between the second supply passage and a corresponding one of the first supply passages in the third direction, each of the supply connection openings connecting the second supply passage and the corresponding one of the first supply passages in the third direction; and a plurality of discharge connection openings each provided between the second discharge passage and a corresponding one of the first discharge passages in the third direction, each of the discharge connection openings connecting the second discharge passage and the corresponding one of the first discharge passages in the third direction, wherein, where an area of a cross section of each of the first supply passages on a plane orthogonal to the first direction is defined as a cross-sectional area of the first supply passage, (C) the cross-sectional area of each of the first supply passages increases in the first direction so as to be larger at a portion of each of the first supply passages farther from the corresponding one of the supply connection openings than at a portion thereof closer to the corresponding one of the supply connection openings in the first direction or (D) the cross-sectional area of each of the first supply passages decreases in the first direction so as to be smaller at a portion of each of the first supply passages farther from the corresponding one of the supply connection openings in the first direction than at a portion thereof closer to the corresponding one of the supply connection openings in the first direction.

18. A liquid ejection head, comprising:

a plurality of individual passages respectively including nozzles;

a plurality of first supply passages each extending in a first direction so as to be connected to a part of the individual passages, the first supply passages being arranged in a second direction that intersects the first direction, a liquid being supplied to the part of the individual passages through a corresponding one of the first supply passages;

a plurality of first discharge passages each extending in the first direction so as to be connected to a part of the individual passages, the first discharge passages being arranged in the second direction, the liquid being discharged from the part of the individual passages through a corresponding one of the first discharge passages;

a second supply passage extending in the second direction and overlapping the first supply passages in a third direction that intersects a plane parallel to both the first direction and the second direction, the second supply passage communicating with the first supply passages to supply the liquid to the first supply passages;

a second discharge passage extending in the second direction and overlapping the first discharge passages in the third direction, the second discharge passage communicating with the first discharge passages to discharge the liquid from the first discharge passages;

a plurality of supply connection openings each provided between the second supply passage and a corresponding one of the first supply passages in the third direction, each of the supply connection openings connecting the second supply passage and the corresponding one of the first supply passages in the third direction; and a plurality of discharge connection openings each provided between the second discharge passage and a corresponding one of the first discharge passages in the third direction, each of the discharge connection openings connecting the second discharge passage and the corresponding one of the first discharge passages in the third direction;

wherein, where an area of a cross section of each of the first discharge passages on a plane orthogonal to the first direction is defined as a cross-sectional area of the first discharge passage, (E) the cross-sectional area of each of the first discharge passages increases in the first direction so as to be larger at a portion of each of the first discharge passages farther from the corresponding one of the discharge connection openings in the first direction than at a portion thereof closer to the corresponding one of the discharge connection openings in the first direction or (F) the cross-sectional area of each of the first discharge passages decreases in the first direction so as to be smaller at a portion of each of the first discharge passages farther from the corresponding one of the discharge connection openings in the first direction than at a portion thereof closer to the corresponding one of the discharge connection openings in the first direction.

* * * * *